US005610321A

United States Patent [19]

Shinmoto

[11] Patent Number: 5,610,321

[45] Date of Patent: Mar. 11, 1997

[54] SENSOR FAILURE DETECTION SYSTEM FOR AIR-TO-FUEL RATIO CONTROL SYSTEM

[75] Inventor: Kazuhiro Shinmoto, Hiroshima, Japan

[73] Assignee: Mazda Motor Corporation, Hiroshima-ken, Japan

[21] Appl. No.: 409,987

[22] Filed: Mar. 24, 1995

[30] Foreign Application Priority Data

Mar. 25, 1994 [JP] Japan ..... 6-055436

[51] Int. Cl.[6] ..... F02D 41/14

[52] U.S. Cl. ..... 73/23.32; 73/117.3; 60/277

[58] Field of Search ..... 73/23.31, 23.32, 73/112, 116, 117.2, 117.3, 118.1; 60/274, 276, 277, 285

[56] References Cited

U.S. PATENT DOCUMENTS

| | | | |
|---|---|---|---|
| 5,077,971 | 1/1992 | Kumagai et al. | 60/276 |
| 5,090,199 | 2/1992 | Ikuta et al. | 60/276 |
| 5,095,878 | 3/1992 | Kumagai et al. | 60/276 |
| 5,157,920 | 10/1992 | Nakaniwa | 60/276 |
| 5,193,339 | 3/1993 | Furuya | 60/276 |
| 5,337,555 | 8/1994 | Tokuda et al. | 60/276 |
| 5,375,416 | 12/1994 | Iwata et al. | 60/276 |
| 5,402,640 | 4/1995 | Uchikawa | 60/276 |
| 5,440,877 | 8/1995 | Kamura et al. | 60/276 |

FOREIGN PATENT DOCUMENTS 62-147034 7/1987 Japan .

*Primary Examiner*—Elizabeth L. Dougherty
*Assistant Examiner*—Eric S. McCall
*Attorney, Agent, or Firm*—Keck, Mahin & Cate

[57] ABSTRACT

A failure detection system for an air-to-fuel ratio control system executes an air-to-fuel ratio feedback control based on a first output from a first air-to-fuel ratio sensor before a catalytic converter. The system detects a feedback correction value, corrected according to a second output from a second air-to-fuel ratio sensor after the catalytic converter, which is above a predetermined value so as to determine that the first air-to-fuel ratio sensor has something wrong with it. The system also detects a change in the second output during correction of the feedback correction value so as to determine that the second air-to-fuel ratio sensor has something wrong with it when a change which is less than a predetermined change is detected.

19 Claims, 5 Drawing Sheets

Fig. 2
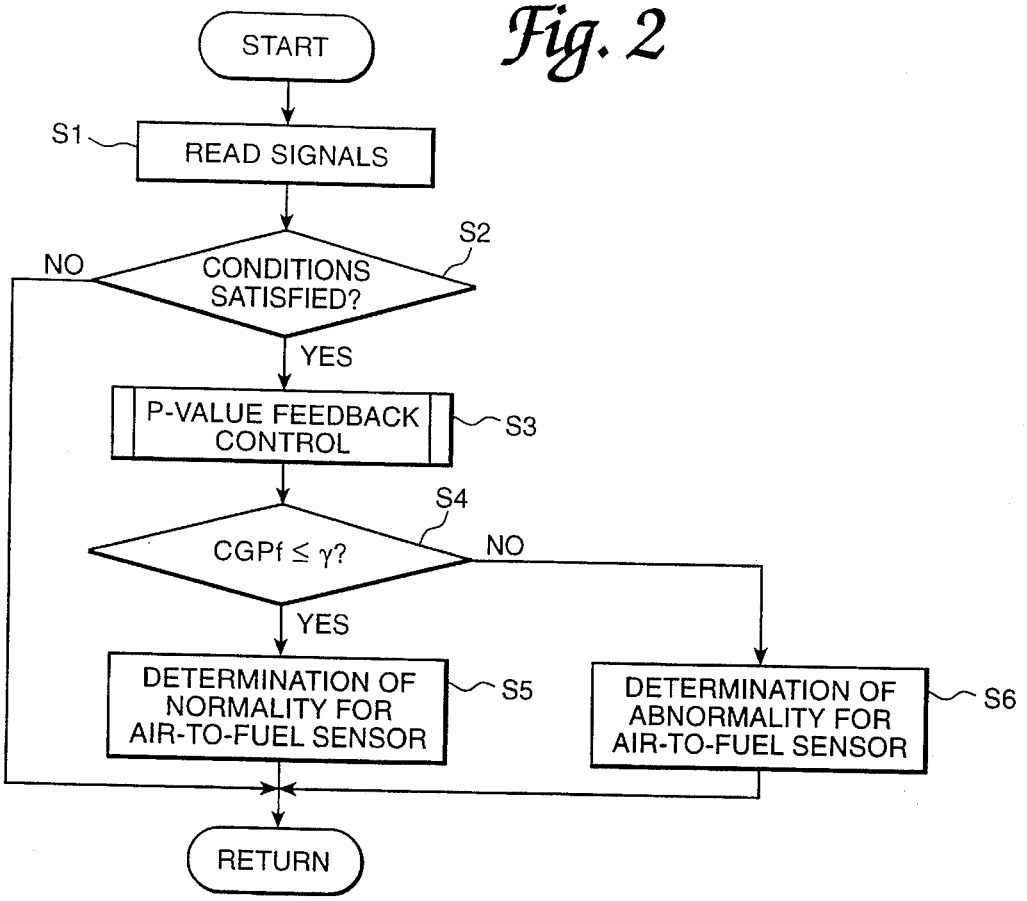
Fig. 3(A)
Fig. 3(B)
Fig. 3(C)
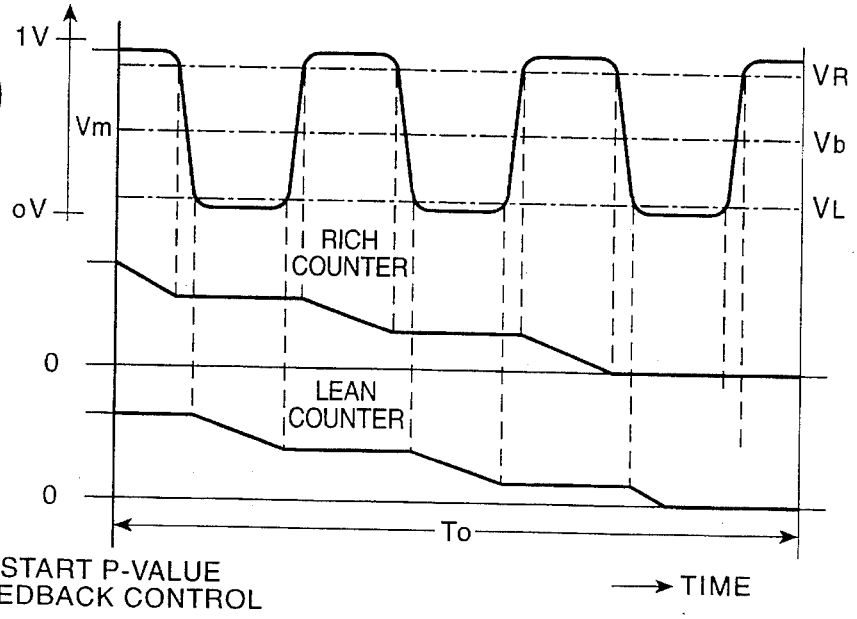

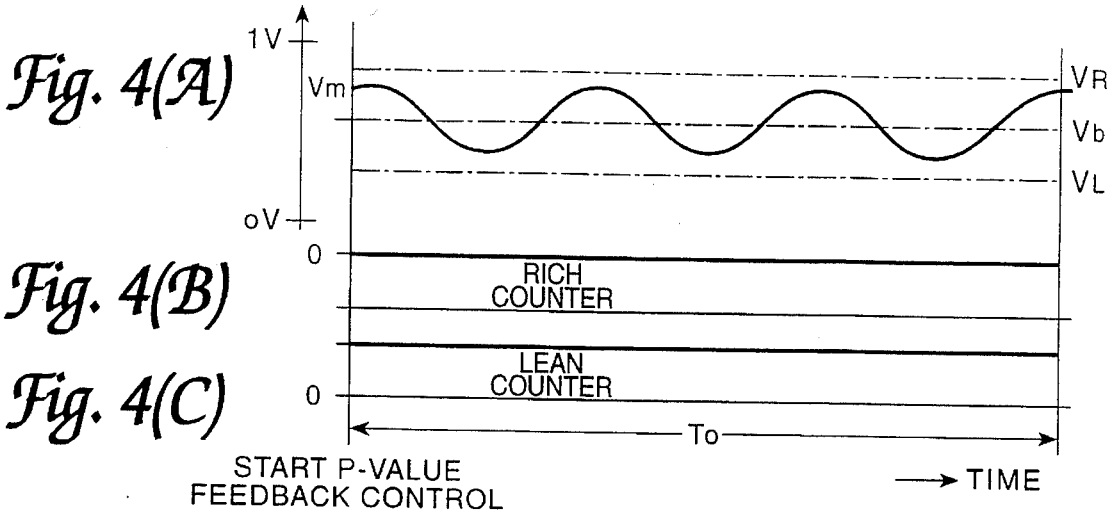
Fig. 5
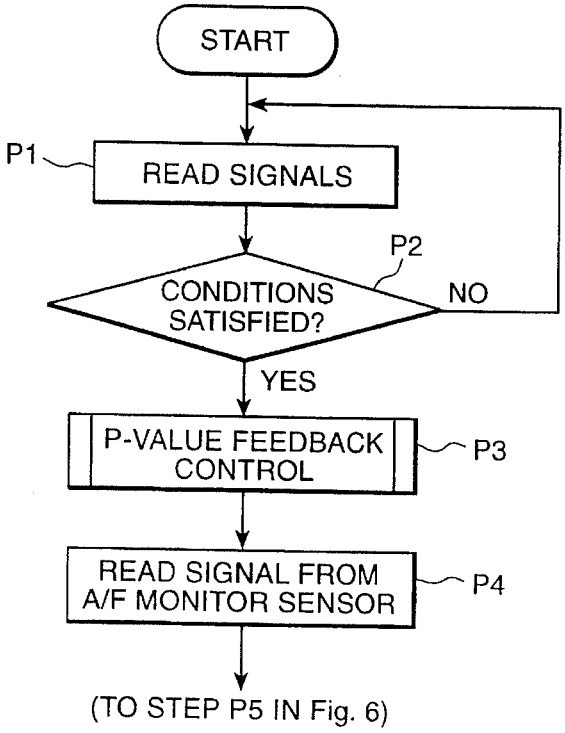

Fig. 7(A)
(PRIOR ART)
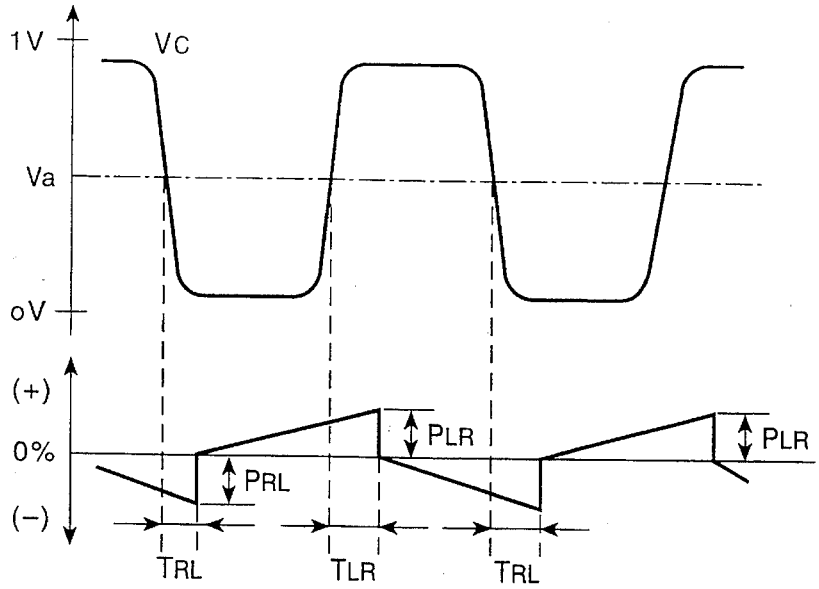
Fig. 7(B)
(PRIOR ART)
Fig. 8(A)
(PRIOR ART)
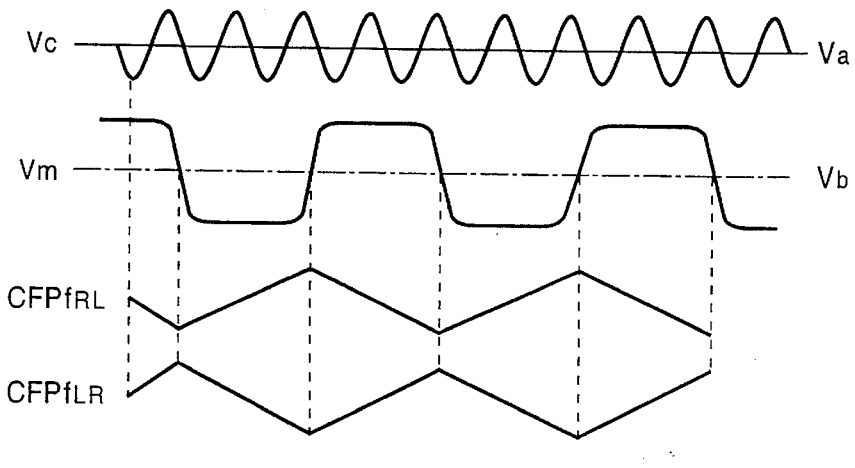
Fig. 8(B)
(PRIOR ART)
Fig. 8(C)
(PRIOR ART)
Fig. 8(D)
(PRIOR ART)
Fig. 8(E)
(PRIOR ART)
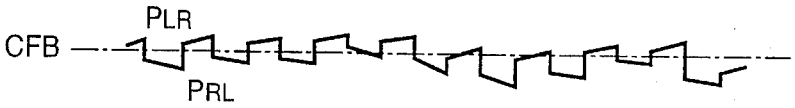
Fig. 9(A)
(PRIOR ART)
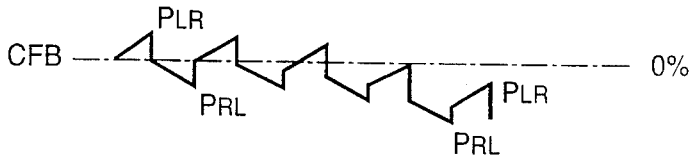
Fig. 9(B)
(PRIOR ART)
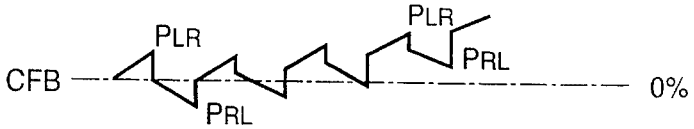

SENSOR FAILURE DETECTION SYSTEM FOR AIR-TO-FUEL RATIO CONTROL SYSTEM

BACKGROUND OF THE INVENTION

1. Field of the Invention

The present invention relates to a sensor failure detection system for an air-to-fuel ratio control system of a type having air-to-fuel ratio sensors in front of, or before, and behind, or after, a catalytic converter.

2. Description of Related Art

Automobile internal combustion engines are typically equipped with a catalytic converter for emission control or exhaust gas purification. In order for the ability of the catalytic converter to be maximized, an exhaust sensor of an air-to-fuel ratio control system, such as an oxygen ($O_2$) sensor disposed before the catalytic converter, detects the oxygen content of exhaust gas. The air-to-fuel ratio control system determines the proper air-to-fuel ratio and then constantly monitors engine exhaust to verify the accuracy of the mixture setting. Specifically, whenever the exhaust sensor determines that the oxygen content is improper or "off", the air-to-fuel ratio control system corrects itself to bring the oxygen back to proper levels or predetermined threshold values and tries to maintain a stoichiometric air-fuel mixture, or ideally combustible air-to-fuel ratio, in a feedback control range which is predetermined according to engine speeds and engine loads.

For the purpose of providing a brief description of closed loop air-to-fuel ratio controls or feedback air-to-fuel ratio controls in such single exhaust sensor types of air-to-fuel ratio control systems, reference is made to FIGS. 7–9.

As shown by a time chart (A) of an output voltage Vc of the exhaust sensor in FIG. 7, the air-to-fuel ratio control system judges an air-fuel mixture to be lean when the output voltage Vc varies by passing through a judging level Va, predetermined at a median of latitude in output change, from a value in a lean region to a value in a rich region. The air-to-fuel mixture is judged to be rich when the output voltage Vc varies by passing through the judging level Va. According to a result of the judgement, the air-to-fuel ratio control system changes a feedback control factor CFB, as indicated by a time chart (B) in FIG. 7, at a time at which the output voltage Vc reaches and passes the judging level Va. In this instance, because a response time of the exhaust sensor is different between when the output voltage Vc varies from the lean region to the rich region and when the output voltage Vc varies from the rich region to the lean region, the air-to-fuel ratio control system varies the feedback control factor CFB with a delay time ($T_{RL}$ or $T_{LR}$) from the judging time. Specifically, the system increases the feedback control factor CFB so as to enrich an air-fuel mixture after the delay time $T_{RL}$ from the time of lean judgement. Similarly, the system increases the feedback control factor CFB so that an air-fuel mixture gets leaner after the delay time $T_{LR}$ from the time of rich judgement. In the time chart, a leap or skip ($P_{RL}$ or $P_{LR}$) represents what is called a P-value which is a proportional term of the feedback control factor CFB.

This type of exhaust sensor experiences (1) variations in characteristics and (2) deterioration in sensing ability due to aging. Such variations and deterioration have an adverse effect on performance of catalytic converters and, consequently, provide a decline in emission control.

The exhaust gas purifying efficiency of a catalytic converter is expressed by oxygen consumption. Therefore, the catalytic converter has a property such that deviations from the optimum purifying efficiency, which is obtained at an ideally combustible air-to-fuel ratio (expressed by $\lambda=1$), can be found on the basis of the oxygen content of exhaust gas downstream from the catalytic converter. By utilizing this property and providing an exhaust sensor as a monitor, downstream from the catalytic converter, it is possible to use the air-to-fuel ratio control system to compensate for variations in and deterioration of characteristics of exhaust sensors and to detect failure of the exhaust sensor and/or characteristic deterioration of the catalytic converter. In other words, the detection of failure of the exhaust sensor and/or characteristic deterioration of the catalytic converter is made by controlling an air-to-fuel ratio on the basis of a feedback control factor. The feedback control factor is determined according to an output of the exhaust sensor (which is hereafter referred to as the air-to-fuel ratio control sensor) upstream from the catalytic converter and corrected according to an output of the exhaust sensor (which is hereafter referred to as the air-to-fuel ratio monitor sensor) downstream from the catalytic converter. This air-to-fuel ratio control system is called a double sensor type system.

One air-to-fuel ratio control system of this double sensor type provides what is called leap or P-value feedback control. In such a control, a leap value $P_{RL}$ or $P_{LR}$ is controlled on the basis of an output of the air-to-fuel ratio monitor sensor. Such an air-to-fuel ratio control system of this P-value feedback control type is described in, for instance, Japanese Unexamined Patent Publication No. 62-147034. The approach used is to execute the P-value feedback control exclusively when predetermined conditions are satisfied, in a predetermined range of engine speeds and engine loads, for air-to-fuel ratios for feedback control in an interval after a predetermined time from engine starting.

Time charts (A) and (B), depicted in FIG. 8, show an output voltage Vc of a control sensor upstream from a catalytic converter and an output voltage Vm of a monitor sensor upstream from the catalytic converter, respectively. The output voltage Vm, which is different in phase from the output voltage Vc and has a frequency smaller than the output voltage Vc, changes above and below the judging level Vb taken as the center of change. Time charts (C) and (D), depicted in FIG. 8, show correction coefficients $CGPf_{RL}$ and $CGPf_{LR}$ for leaps $P_{RL}$ and $P_{LR}$, respectively. When the output voltage Vm of the monitor sensor is above a judging level Vb, it is judged that an air-to-fuel ratio is such that the air and fuel mixture is rich. The leap correction coefficient $CGPf_{RL}$ is then decreased. On the other hand, the leap correction coefficient $CGPf_{LR}$ is increased. As a result, when the output voltage Vm of the monitor sensor is above the judging level Vb, a feedback control factor CFB, indicated by a time chart (E) in FIG. 8, is gradually changed toward a larger negative or minus value. On the other hand, when the output voltage Vm of the monitor sensor is below the judging level Vb, it is judged that an air-to-fuel ratio is such that the air fuel mixture is lean. The leap correction coefficient $CGPf_{RL}$ is increased. The leap correction coefficient $CGPf_{LR}$ is decreased. As a result, when the output voltage Vm of the monitor sensor is below the judging level Vb, the feedback control factor CFB is gradually changed toward a larger positive or plus value.

In the known air-to-fuel ratio control system of the double sensor type mentioned above, when each of these correction coefficients $CGPf_{RL}$ and $CGPf_{LR}$ or, otherwise, the average value of these correction coefficients CGPfRL and CGPfLR, exceeds a predetermined value, it is determined that the control sensor upstream from the catalytic converter is out of order or abnormal.

If something should go wrong with the monitor sensor, the air-to-fuel ratio control will inaccurately detect functional deterioration of the control sensor and will experience deteriorated emission control, functional deterioration of the catalytic converter and the like.

SUMMARY OF THE INVENTION

It is an object of the present invention to provide a failure detection system for a double sensor type of air-to-fuel ratio control system which detects failure of both an air-to-fuel ratio control sensor disposed in front of, or before, a catalytic converter and an air-to-fuel ratio monitor sensor disposed behind, or after, the catalytic converter.

The object of the present invention is achieved by providing a failure detection system for an air-to-fuel ratio control system of a type having an air-to-fuel ratio control sensor disposed upstream from a catalytic converter for purifying exhaust gas from an automobile internal combustion engine and an air-to-fuel ratio monitor sensor disposed downstream from the catalytic converter. The air-to-fuel ratio monitor sensor executes an air-to-fuel ratio feedback control based on an output from the air-to-fuel ratio control sensor so as to cause an air-to-fuel ratio of a fuel mixture to approach an ideally combustible air-to-fuel ratio. The failure detection system detects when a corrected value of a feedback correction value (called a P-value), which is corrected according to an output from the air-to-fuel ratio monitor sensor, is above a predetermined value so as to determine that something has gone wrong with the air-to-fuel ratio control sensor. The failure detection system also detects a change in an output from the air-to-fuel ratio monitor sensor during correction of a feedback correction value so as to determine that something has gone wrong with the air-to-fuel ratio monitor sensor when detecting an output change which is less than a predetermined change.

According to a preferred embodiment of the invention, the failure detection system makes a correction of the feedback correction value so that a fuel mixture gets leaner when the output from the air-to-fuel ratio monitor sensor is on a rich side and indicates that the air and fuel mixture is rich. Similarly, the system enriches a fuel mixture when the sensor output is on the lean rich side and indicates that the air and fuel mixture is leaner. The failure detection system includes time counters which additionally count down times for which the output from the air-to-fuel ratio monitor sensor remains above a predetermined upper limit and below a predetermined lower limit, respectively. When either one or, otherwise, both of the times added up has or have not reached a predetermined time in a predetermined interval, the failure detection system determines that a change in the output from the air-to-fuel ratio monitor sensor is less than the predetermined change, i.e., that something has gone wrong with the air-to-fuel ratio monitor sensor.

The failure detection system further prohibits a determination that the air-to-fuel ratio control sensor has failed when something has gone wrong with the air-to-fuel ratio monitor sensor. Because the failure detection system, according to the present invention, detects failure of the air-to-fuel ratio monitor sensor by monitoring an output of the air-to-fuel ratio monitor sensor downstream from a catalytic converter during execution of the P-value feedback control, the detection of failure of the air-to-fuel ratio monitor sensor is accurate. It is impossible to determine failure of the air-to-fuel ratio monitor sensor based on an output of the air-to-fuel ratio monitor sensor, which tends to remain either on a rich side or on a lean side, continuously, due to a storage effect of the catalytic converter if the P-value feedback control is not being executed. The P-value feedback control, however, causes an output of the air-to-fuel ratio monitor sensor to be reversed.

Failure of the air-to-fuel ratio monitor sensor is determined easily by determining that a change in an output from the air-to-fuel ratio monitor sensor is less than the predetermined change when either one or, otherwise, both of the times added up has or have not reached a predetermined time in a predetermined interval. Furthermore, prohibiting the determination of failure of the air-to-fuel ratio control sensor when something has gone wrong with the air-to-fuel ratio monitor sensor eliminates incorrect detection of failure of the air-to-fuel ratio sensors and deteriorated emission control.

BRIEF DESCRIPTION OF THE DRAWINGS

The above and other objects and features of the present invention will be clearly understood from the following description with respect to a preferred embodiment thereof when considered in conjunction with the accompanying drawings, in which:

FIG. 2 is a flow chart illustrating an air-to-fuel ratio control sensor failure detection routine;

FIG. 3 shows time charts of an output of an air-to-fuel ratio monitor sensor and a count of a time counter while the air-to-fuel ratio monitor sensor is normal;

FIG. 4 shows time charts of the output of an air-to-fuel ratio monitor sensor which experiences deterioration;

FIGS. 5 and 6 are flow charts illustrating an air-to-fuel ratio monitor sensor failure detection routine;

FIG. 7 shows time charts used for a description of air-to-fuel ratio feedback control by a prior art single sensor type of air-to-fuel ratio feedback control system;

FIG. 8 shows time charts used for a description of P-value feedback control by a prior art double sensor type of air-to-fuel ratio feedback control system; and FIG. 9 shows time charts illustrating an air-to-fuel ratio feedback control factor in the P-value feedback control.

DESCRIPTION OF THE PREFERRED EMBODIMENT

Figure 1:
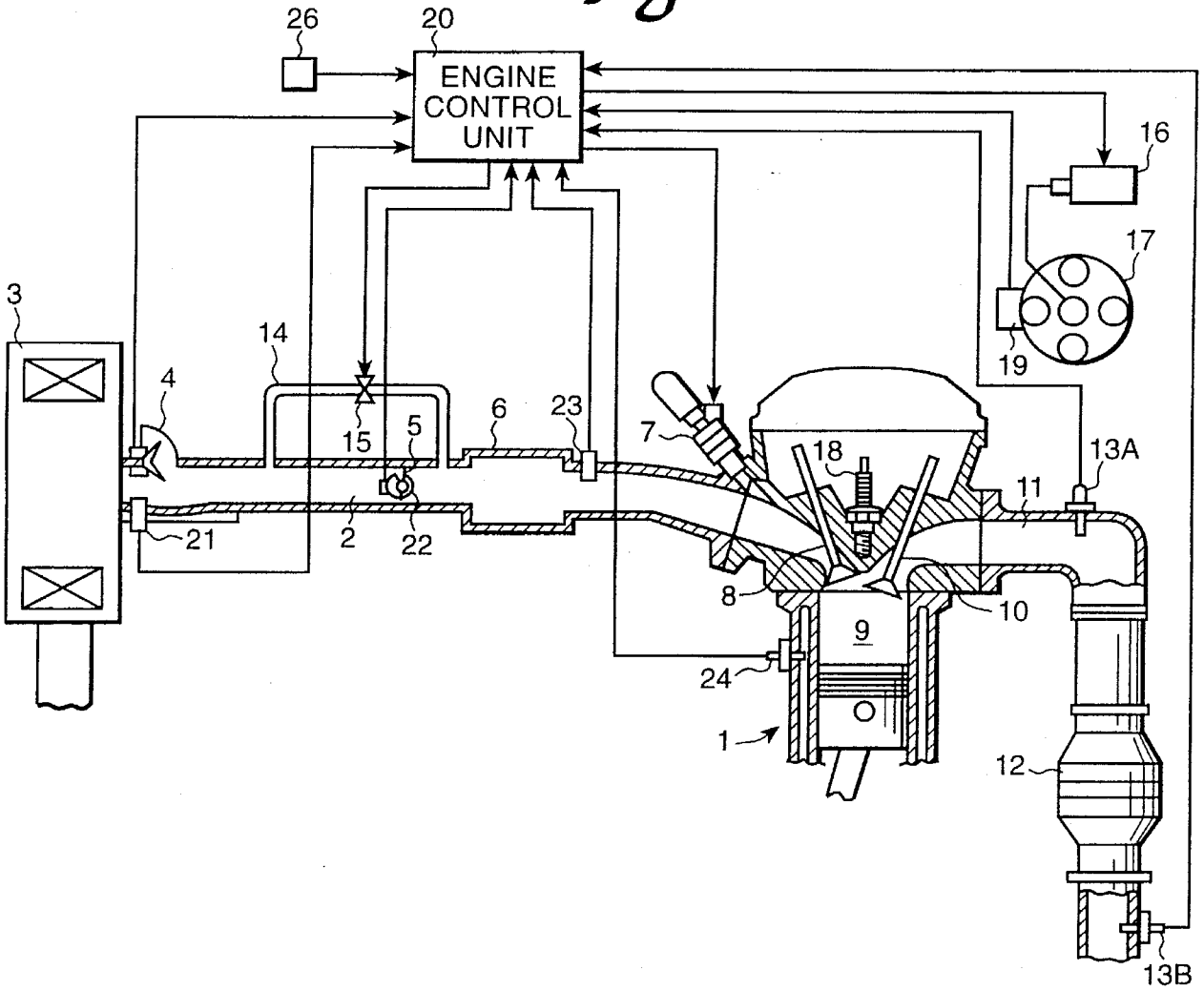
FIG. 1 is a schematic illustration of an internal combustion engine equipped with a sensor failure detection system for an air-to-fuel ratio control system in accordance with a predetermined embodiment of the present invention.

Referring now to the drawings in detail and, in particular, to FIG. 1, an internal combustion engine 1 is equipped with a sensor failure detection system for an air-to-fuel ratio control system of the type having air-to-fuel ratio sensors before and after a catalytic converter. In accordance with a preferred embodiment of the present invention, the engine is provided with an intake pipe 2 and an exhaust pipe 11, and the intake pipe 2 is equipped, in order from an upstream end toward a combustion chamber 9, with an air cleaner 3, a vane type of air-flow sensor 4, a throttle valve 5, a surge tank 6, and a fuel injection valve 7. The intake pipe 2 is further provided with a bypass pipe 14, which branches off from the intake pipe upstream of the throttle valve 5 and joins together with the intake pipe downstream of the throttle valve 5, for allowing intake air to bypass and then flow past the throttle valve 5. This bypass pipe 14 is equipped with a duty solenoid valve 15 for regulating the amount of intake air flowing therethrough. The intake pipe 2 is further equipped with various sensors, such as a temperature sensor 21 immediately after the air cleaner 3 for detecting the temperature of intake air, an opening sensor 22 cooperating with the throttle valve 5 for detecting throttle valve openings, and a pressure sensor 23 for detecting a boost pressure in the surge tank 6. The engine 1 is provided with intake valves 8 and exhaust valves 10 which open and close at an appropriate timing.

The exhaust pipe 11 is equipped, in order from the combustion chamber 9, with a catalytic converter 12, an upstream or air-to-fuel ratio (A/F) control sensor 13A disposed before the catalytic converter 12, and a downstream or air-to-fuel ratio (A/F) monitor sensor 13B disposed after the catalytic converter 12. The engine 1 is further provided with a spark plug 18. The engine 1 cooperates with an engine control unit 20, incorporating a microcomputer, which controls an ignition system so that a distributor 17 distributes a high voltage generated by an ignition coil 16 to the spark plug 18 of a proper cylinder at a correct time and provides an ignition pulse having a pulse width determined based on engine operating conditions. The distributor 17 includes a speed sensor 19 for detecting a speed of, for instance, a rotor or a distributor shaft (not shown), which turns at one-half crankshaft speed, rather than the speed of engine.

In order to perform the air-to-fuel ratio feedback control in the predetermined feedback control range of engine speeds and engine loads so that an ideally combustible air-to-fuel ratio is developed, the engine control unit 20 receives various signals. These signals represent the temperature of engine cooling water detected by a temperature sensor 24 and the speed of the vehicle detected by a speed sensor 26 and also include signals from the air-flow sensor, the temperature sensor 21, the opening sensor 22, the pressure sensor 23, the speed sensor 19, and the air-to-fuel ratio (A/F) control sensor 13A. Each of these elements and sensors, per se, is well known to those skilled in the art and may be of any type well known in the art. Further, in order to perform the P-value feedback control, the engine control unit 20 receives a signal from the air-to-fuel ratio (A/F) monitor sensor 13B in addition to a signal from the air-to-fuel ratio (A/F) control sensor 13A. This P-value feedback control is executed during execution of the air-to-fuel ratio feedback control in a predetermined interval after a predetermined time from engine starting. Specifically, the sensor failure detection system monitors execution of the P-value feedback control, according to an output of the monitor air-to-fuel ratio (A/F) sensor 13B under ordinary driving conditions, so that the air-to-fuel ratio control system changes a correction coefficient $CGPfR_L$ or $CGPfL_R$ for a leap $P_{RL}$ or $P_{LR}$, respectively. Ordinary driving conditions are defined, for instance, by various factors such as vehicle speeds between 5 and 55 Km/h, engine speeds between 1,000 and 2,000 rpm, engine loads, represented by a quotient of the amount of intake air divided by the speed of the engine, of between 23% and 35%, boost pressure between −500 and −300 mmHg, changes ($\Delta Ne$) in engine speed per unit time less than a predetermined threshold value ($\alpha$), and changes ($\Delta C$) in engine load per unit time less than a predetermined threshold value ($\beta$). Further, the sensor failure detection system monitors an average value of these correction coefficients $CGPfR_L$ and $CGPfL_R$ so as to compare it with a predetermined threshold value $\gamma$. When the sensor failure detection system detects an average value which is larger than the threshold value $\gamma$, the air-to-fuel ratio (A/F) control sensor 13A is determined to be abnormal or out of order.

Figure 6:
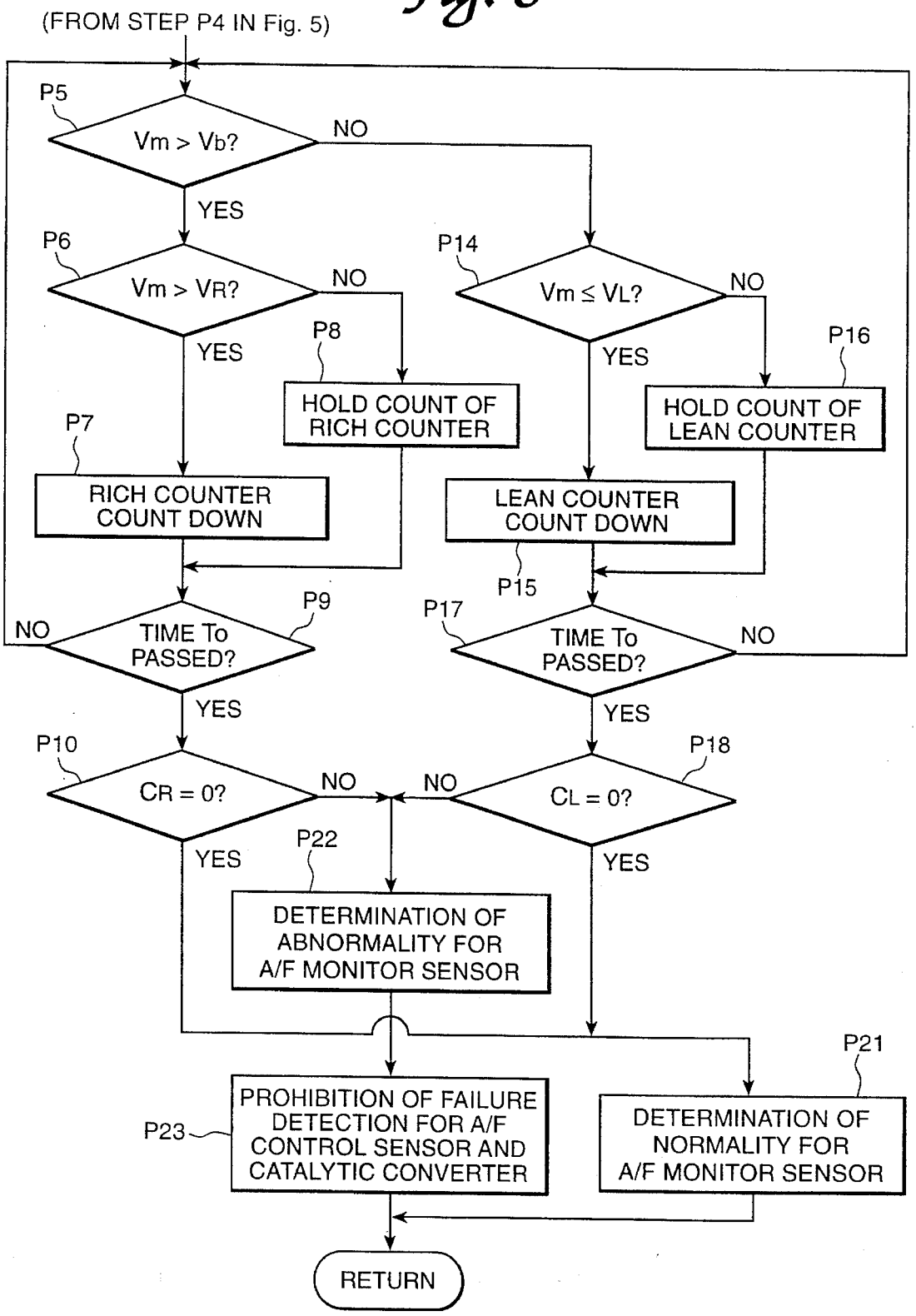

The operation of the sensor failure detection system is best understood by reviewing FIG. 2, 5 and 6, which are flow charts illustrating failure detection routines for the air-to-fuel ratio (A/F) control sensor 13A and the air-to-fuel ratio (A/F) monitor sensor 13B, respectively, for the microcomputer. Programming a computer is a skill well understood in the art. The following description is written to enable a programmer having ordinary skill in the art to prepare an appropriate program for the microcomputer. The particular details of any such program would, of course, depend upon the architecture of the particular computer selected.

FIG. 2 is a flow chart of the air-to-fuel ratio control sensor failure detection routine for the microcomputer. The flow chart sequence commences and control passes directly to a function block at step S1 at which various signals are read in. Then, a decision is made at step S2 as to whether or not the conditions for execution of the P-value feedback control are satisfied or, in other words, whether or not all of the driving conditions are ordinary If the answer to this decision is "NO," then one or more of the ordinary driving conditions is not satisfied. Then, the air-to-fuel ratio control sensor failure detection routine is terminated. On the other hand, if the answer to the decision is "YES," then the ordinary driving conditions are completely satisfied. A P-value feedback control subroutine is then called for at step S3. Subsequently, a decision is made at step S4 as to whether or not an arithmetic average CGPf of correction coefficients $CGPfR_L$ and $CGPfL_R$ is equal to or less than the predetermined threshold value $\gamma$. The sensor failure detection system determines that the air-to-fuel ratio (A/F) control sensor 13A is normal when the answer to this decision is "YES," and the arithmetic average CGPf of correction coefficients $CGPfR_L$ and $CGPfL_R$ is equal to or less than the predetermined threshold value $\gamma$, at step S5. The sensor failure detection system determines that the air-to-fuel ratio (A/F) control sensor 13A is abnormal or out of order when the answer to the decision is "NO," and the arithmetic average CGPf of correction coefficients $CGPffR_L$ and $CGPfL_R$ is not less than the predetermined threshold value $\gamma$, at step S6. After the determination at step S5 or step S6, the air-to-fuel ratio control sensor failure detection routine is terminated.

A description of the determination of abnormality of the air-to-fuel ratio (A/F) monitor sensor 13B will now be given with reference to FIGS. 3 and 4.

As shown by time charts (A) in FIGS. 3 and 4, respectively, threshold values $V_R$ and $V_L$ are previously established above and below a judging level Vb for rich and lean air-to-fuel ratio judgement, respectively. When an output voltage Vm from the air-to-fuel ratio (A/F) monitor sensor 13B is above the threshold value $V_R$, providing the rich air-to-fuel ratio judgement, a down counter (hereafter referred to as a rich counter) $C_R$ incorporated in the microcomputer counts down, additionally, a time for which the output voltage Vm remains above the threshold value $V_R$ as shown in a time chart (B) in FIG. 3 and holds the count while the output voltage Vm is below the threshold value $V_R$. Similarly, when an output voltage Vm is below the threshold value $V_L$, providing the lean air-to-fuel ratio judgement, another down counter (which is hereafter referred to as a lean counter) $C_L$ incorporated in the microcomputer counts down, additionally, a time for which the output voltage Vm remains below the threshold value $V_L$ as shown in a time chart (C) in FIG. 3 and holds the count while the output voltage Vm is above the threshold value $V_L$. These counters $C_R$ and $C_L$ are adapted to count down to a predetermined count.

The air-to-fuel ratio (A/F) monitor sensor 13B provides an output Vm which repeatedly and alternately moves beyond the rich threshold value $V_R$ and the lean threshold value $V_L$ as shown by a time chart (A) in FIG. 3. Thus, as long as they are operating normally, both of the counters count down over a predetermined time before a lapse of the predetermined time To. However, due to degradation of the air-to-fuel ratio (A/F) monitor sensor 13B from aging, the output Vm will vary between the rich threshold value $V_R$ and the lean threshold value $V_L$ as shown by a time chart (A) in FIG. 4. Consequently, in this situation, both of the counters continuously hold the predetermined count and do not reach zero (0) after a lapse of the predetermined time To. Such a default in counting down indicates a failure of the air-to-fuel ratio (A/F) monitor sensor 13B. When there is a default in counting down, i.e. a failure of the air-to-fuel ratio (A/F) monitor sensor 13B, the air-to-fuel ratio control sensor failure detection routine is suspended so as to prevent incorrect detection of functional deterioration of the air-to-fuel ratio (A/F) control sensor 13A. Also, the P-value feedback control routine is prohibited so as to prevent deteriorated emission control.

FIGS. 5 and 6 are flow charts of the air-to-fuel ratio monitor sensor failure detection routine for the microcomputer. The flow chart sequence commences and control passes directly to a function block at step P1, at which various signals are read in. Then, a decision is made at step P2 as to whether or not the condition for execution of the P-value feedback control is satisfied. If the answer to this decision is "NO," then, the air-to-fuel ratio control sensor failure detection routine is restarted. On the other hand, if the answer to the decision made at step P2 is "YES," then the P-value feedback control subroutine is called for at step P3. Subsequently, an output voltage Vm from the air-to-fuel ratio (A/F) monitor sensor 13B is read in at step P4. Based on the output voltage Vm, a decision is made at step P5 as to whether or not the output voltage Vm is above the judging level Vb, or in a rich range. If the answer to this decision is "YES," then, a decision is made at step P6 as to whether or not the output voltage Vm is above the rich threshold value $V_R$.

If the output voltage Vm is above the rich threshold value $V_R$, that is, the answer to the decision made at step P6 is "YES," then, the rich counter $C_R$ starts to count down, additionally, a time for which the output voltage Vm remains above the rich threshold value $V_R$ at step P7. However, if the output voltage Vm is below the rich threshold value $V_R$, that is, the answer to the decision made at step P6 is "NO," then the rich counter $C_R$ holds its count at step S8. Thereafter, a decision is made at step P9 as to whether or not the rich counter $C_R$ has counted down the predetermined time To. If the answer to this decision is "NO," then the decision concerning the output voltage Vm at step P5 is repeated. On the other hand, if the answer to the decision made at step P9 is "YES," then, a decision is made at step P10 as to whether or not the rich counter $C_R$ has counted down to zero (0). If the answer to this decision is "YES," then it is determined, at step P21, that the air-to-fuel ratio (A/F) monitor sensor 13B is normally operating. On the other hand, if the answer to the decision made at step P10 is "NO," then, it is determined, at step P22 that something should go wrong with the air-to-fuel ratio (A/F) monitor sensor 13B. Immediately thereafter, the air-to-fuel ratio control sensor failure detection routine is prohibited at step P23. Simultaneously with the prohibition of the air-to-fuel ratio control sensor failure detection routine, the sensor failure detection system halts the detection of deterioration of the catalytic converter 12 which is made on the basis of the ratio of an integrated output voltage Vm to an integrated output voltage Vc.

If the answer to the decision concerning the output voltage Vm made at step P5 is "NO," then the output voltage Vm indicates a lean fuel-mixture. Then, a decision is made at step P14 as to whether or not the output voltage Vm is below the lean threshold value $V_L$. If the answer to this decision is "YES," then at step, P15, the lean counter $C_L$ starts to count down, additionally, a time for which the output voltage Vm remains below the lean threshold value $V_L$. However, if the output voltage Vm is above the lean threshold value $V_L$, that is, the answer to the decision made at step P14 is "NO," then the lean counter Cn holds its count at step P16. Thereafter, a decision is made at step P17 as to whether or not the lean counter $C_L$ has counted down the predetermined time To. If the answer to the decision made at step P17 is "NO," then, the decision concerning the output voltage Vm at step P5 is repeated. On the other hand, if the answer to the decision made at step P17 is "YES," then a decision is made at step P18 as to whether or not, the lean counter $C_L$ has counted down to zero (0). If the answer to the decision made at step P18 is "YES," then it is determined at step P21 that the air-to-fuel ratio (A/F) monitor sensor 13B is normally operating. On the other hand, if the answer to the decision made at step P18 is "NO," then, it is determined at step P22 that something should go wrong with the air-to-fuel ratio (A/F) monitor sensor 13B. Subsequently, the air-to-fuel ratio control sensor failure detection routine is prohibited simultaneously with a halt in the detection of deterioration of the catalytic converter 12 at step P23. Immediately after the determination of normality of the air-to-fuel ratio (A/F) monitor sensor 13B at step P21 or the prohibition of the air-to-fuel ratio control sensor failure detection routine at step P23, the air-to-fuel ratio monitor sensor failure detection routine terminates.

In the air-to-fuel ratio monitor sensor failure detection routine, it is determined that something is wrong with the air-to-fuel ratio (A/F) monitor sensor 13B when the add up time, for which the output voltage Vm remains above the rich threshold value $V_R$ or below the lean threshold value $V_L$, does not reach the predetermined time (which is represented by the predetermined count counted down by the rich and lean counters $C_R$ and $C_L$) within the predetermined time To. Nevertheless, failure of the air-to-fuel ratio (A/F) monitor sensor 13B may be determined when either one of, or both of, the add up times does, or do, not reach the predetermined time within the predetermined time To.

It is to be understood that although the present invention has been described with regard to preferred embodiments thereof, various other embodiments and variants may occur to those skilled in the art which are within the scope and spirit of the invention. Such other embodiments and variants are intended to be covered by the following claims.

What is claimed is:

1. A failure detection system for an air-to-fuel ratio control system, having an upstream air-to-fuel ratio sensor disposed upstream from a catalytic converter for purifying exhaust gas from an automobile internal combustion engine and a downstream air-to-fuel ratio sensor disposed downstream from the catalytic converter, which executes an air-to-fuel ratio feedback control based on an output from said upstream air-to-fuel ratio sensor so as to bring an air-to-fuel ratio of a fuel mixture as close to a desired air-to-fuel ratio as possible, said failure detection system comprising:

correction value establishing means for establishing a feedback correction value for said air-to-fuel ratio feedback control;

control value correction means for making a correction of said feedback correction value according to an output from said downstream air-to-fuel ratio sensor;

first failure detection means for detecting a corrected feedback correction value above a predetermined value so as to determine that something is wrong with said upstream air-to-fuel ratio sensor;

second failure detection means for detecting a change in an output from said downstream air-to-fuel ratio sensor during execution of said correction of said feedback correction value so as to determine that something is wrong with said downstream air-to-fuel ratio sensor when detecting that said change is less than a predetermined change in a predetermined time interval.

2. A failure detection system as defined in claim 1, wherein each of said upstream and downstream sensors is an oxygen sensor for detecting an oxygen content of exhaust gas from said engine.

3. A failure detection system as defined in claim 1, wherein said control value correction means makes said correction of said feedback correction value so that a fuel mixture gets leaner when said output from said downstream air-to-fuel ratio sensor indicates that said fuel mixture is rich and enriches the fuel mixture more when said output from said downstream air-to-fuel ratio sensor indicates that said fuel mixture is too lean.

4. A failure detection system as defined in claim 1, wherein said feedback correction value is a proportional term of a feedback control factor.

5. A failure detection system as defined in claim 1, wherein said second failure detection means counts an additional time for which said output from said downstream air-to-fuel ratio sensor remains above a predetermined upper limit and determines that said change in said output from said downstream air-to-fuel ratio sensor is less than said predetermined change when said additional time has not reached a predetermined time in a predetermined interval.

6. A failure detection system as defined in claim 1, wherein said second failure detection means counts an additional time for which said output from said downstream air-to-fuel ratio sensor remains below a predetermined lower limit and determines that said change in said output from said downstream air-to-fuel ratio sensor is less than said predetermined change when said additional time has not reached a predetermined time in a predetermined interval.

7. A failure detection system as defined in claim 1, wherein said second failure detection means counts an additional time for which said output from said downstream air-to-fuel ratio sensor remains one of (1) above a predetermined upper limit and (2) below a lower limit, respectively, and determines that said change in said output from said downstream air-to-fuel ratio sensor is less than said predetermined change when said additional time has not reached a predetermined time in a predetermined interval.

8. A failure detection system as defined in claim 1, wherein said second failure detection means counts additional time for which said output from said downstream air-to-fuel ratio sensor remains above a predetermined upper limit, counts additional time for which said output from said downstream air-to-fuel ratio sensor remains below a lower limit, and determines that said change in said output from said downstream air-to-fuel ratio sensor is less than said predetermined change when both the additional time for which said output remains above the predetermined upper limit and the additional time for which said output remains below the lower limit have not reached a predetermined time in a predetermined interval.

9. A failure detection system as defined in claim 1, and further comprising prohibition means for prohibiting said first failure detection means from determining that something is wrong with said upstream air-to-fuel ratio sensor when said second failure detection means determines that something is wrong with said downstream air-to-fuel ratio sensor.

10. A failure detection system as defined in claim 3, wherein said feedback correction value is a proportional term of a feedback control factor.

11. A failure detection system as defined in claim 3, wherein said second failure detection means counts an additional time for which said output from said downstream air-to-fuel ratio sensor remains above a predetermined upper limit and determines that said change in said output from said downstream air-to-fuel ratio sensor is less than said predetermined change when said additional time has not reached a predetermined time in a predetermined interval.

12. A failure detection system as defined in claim 3, wherein said second failure detection means counts an additional time for which said output from said downstream air-to-fuel ratio sensor remains below a predetermined lower limit and determines that said change in said output from said downstream air-to-fuel ratio sensor is less than said predetermined change when said additional time has not reached a predetermined time in a predetermined interval.

13. A failure detection system as defined in claim 1, wherein said second failure detection means counts an additional time for which said output from said downstream air-to-fuel ratio sensor remains one of (1) above a predetermined upper limit and (2) below a lower limit, respectively, and determines that said change in said output from said downstream air-to-fuel ratio sensor is less than said predetermined change when said additional time has not reached a predetermined time in a predetermined interval.

14. A failure detection system as defined in claim 3, wherein said second failure detection means counts additional times for which said output from said downstream air-to-fuel ratio sensor remains above a predetermined upper limit, counts additional time for which said output from said downstream air-to-fuel ratio sensor remains below a lower limit, and determines that said change in said output from said downstream air-to-fuel ratio sensor is less than said predetermined change when both the additional time for which said output remains above the predetermined upper limit and the additional time for which said output remains below the lower limit have not reached a predetermined time in a predetermined interval.

15. A failure detection system as defined in claim 3, and further comprising prohibition means for prohibiting said first failure detection means from determining that something is wrong with said upstream air-to-fuel, ratio sensor when said second failure detection means determines that something is wrong with said downstream air-to-fuel ratio sensor.

16. A failure detection system as defined in claim 1, wherein said second failure detection means determines that said change in said output from said downstream air-to-fuel ratio sensor is less than said predetermined change when output from said downstream air-to-fuel ratio sensor is detected in said predetermined time interval to be above a predetermined upper limit and when output from said downstream air-to-fuel ratio sensor is detected in said predetermined time interval to be below a predetermined lower limit.

17. A failure detection system as defined in claim 3, wherein said second failure detection means determines that said change in said output from said downstream air-to-fuel ratio sensor is less than said predetermined change when output from said downstream air-to-fuel ratio sensor is detected in said predetermined time interval to be above a predetermined upper limit and when output from said downstream air-to-fuel ratio sensor is detected in said predetermined time interval to be below a predetermined lower limit.

18. A failure detection system for an air-to-fuel ratio control system, having an upstream air-to-fuel ratio sensor disposed upstream from a catalytic converter for purifying exhaust gas from an automobile internal combustion engine and a downstream air-to-fuel ratio sensor disposed downstream from said catalytic converter, which executes an air-to-fuel feedback control based on an output from said upstream air-to-fuel ratio sensor so as to bring an air-to-fuel ratio of an air-fuel mixture as close to a desired air-to-fuel ratio as possible, said failure detection system comprising;

correction value establishing means for establishing a feedback correction value for said air-to-fuel ratio feedback control;

control value correction means for correcting said feedback correction value according to an output from said downstream air-to-fuel ratio sensor; and failure detection means for detecting a change in output from said downstream air-to-fuel ratio sensor during correction of said feedback correction value so as to determine that said downstream air-to-fuel ratio sensor is wrong when detecting that said change is less than a predetermined change in a predetermined time interval.

19. A failure detection system as defined in claim 18, wherein said failure detection means determines that said change in output from said downstream air-to-fuel ratio sensor is less than said predetermined change when output from said downstream air-to-fuel ratio sensor is detected in said predetermined time interval to be above a predetermined upper limit and when output from said downstream air-fuel ratio sensor is detected in said predetermined time interval to be below a predetermined lower limit.

* * * * *